US007784450B2

(12) United States Patent
Köster et al.

(10) Patent No.: US 7,784,450 B2
(45) Date of Patent: Aug. 31, 2010

(54) EXHAUST-GAS RECIRCULATION DEVICE FOR AN INTERNAL COMBUSTION ENGINE

(75) Inventors: Andreas Köster, Essen (DE); Heinrich Dismon, Gangelt (DE); Martin Nowak, Düsseldorf (DE); Peter Haushälter, Mönchengladbach (DE)

(73) Assignee: Pierburg GmbH, Neuss (DE)

( * ) Notice: Subject to any disclaimer, the term of this patent is extended or adjusted under 35 U.S.C. 154(b) by 0 days.

(21) Appl. No.: 12/175,305

(22) Filed: Jul. 17, 2008

(65) Prior Publication Data

US 2009/0020105 A1 Jan. 22, 2009

(30) Foreign Application Priority Data

Jul. 17, 2007 (DE) ..... 10 2007 033 675

(51) Int. Cl.
*F02B 47/08* (2006.01)
*F02B 47/00* (2006.01)

(52) U.S. Cl. ..... 123/568.17

(58) Field of Classification Search ..... 123/568.17, 123/568.18, 568.15, 568.11, 574; 60/278, 60/280, 605.1, 605.2; 701/108
See application file for complete search history.

(56) References Cited

U.S. PATENT DOCUMENTS 4,693,226 A * 9/1987 Choma ..... 123/568.17
5,056,309 A * 10/1991 Linder et al. ..... 60/278
6,308,666 B1 10/2001 Drecq
6,378,509 B1 * 4/2002 Feucht et al. ..... 123/568.12
7,543,576 B2 * 6/2009 Okada et al. ..... 123/568.17

FOREIGN PATENT DOCUMENTS

DE 37 22 048 A1 1/1989
DE 198 42 349 A1 3/2000
DE 198 51 922 A1 5/2000
DE 10 2005 025 904 A1 12/2006
DE 102007033675.8-13 3/2008

* cited by examiner

*Primary Examiner*—Mahmoud Gimie
(74) *Attorney, Agent, or Firm*—Griffin & Szipl, P.C.

(57) ABSTRACT

An exhaust-gas recirculation device includes a distributor element (14) driven corresponding to the rotational speed of the camshaft (11) of an internal combustion engine (1), wherein, via the distributor element (14), a fluidic connection can be established from an exhaust-gas inlet channel (13) to respectively one exhaust-gas outlet channel (16) of a plurality of exhaust-gas outlet channels (16) corresponding in number to the cylinders. Advantageously, apart from the distributor element (14), use can be made of a control element (22) which is movable via an actuator (47) and by which clearing of the fluidic connection between the outlet opening (21) of the distributor element (14) and the exhaust-gas outlet channels (16) of the exhaust gas recirculation device (9) can be shifted in comparison to the phase angle of the camshaft (11).

13 Claims, 3 Drawing Sheets

EXHAUST-GAS RECIRCULATION DEVICE FOR AN INTERNAL COMBUSTION ENGINE

This application claims priority from German Patent Application No. 10 2007 033 675.8, filed Jul. 17, 2007, the entire disclosure of which is incorporated herein by reference.

FIELD OF THE INVENTION

The present invention relates to an exhaust-gas recirculation device for an internal combustion engine, comprising an exhaust-gas quantity controller and a housing having arranged therein a central exhaust-gas inlet channel and a plurality of exhaust-gas outlet channels corresponding in number to the cylinders of the internal combustion engine, there being arranged a movable distributor element between the exhaust-gas inlet channel and the exhaust-gas outlet channels, the distributor element being driven corresponding to the rotational speed of a camshaft of the internal combustion engine and, via the distributor element, so it is possible to establish a fluidic connection of the exhaust-gas inlet channel to respectively one of the exhaust-gas outlet channels.

BACKGROUND OF THE INVENTION

Exhaust gas recirculation devices and systems are known in various forms. In recent years, various systems for reducing the emission of pollutants have been presented wherein, in order to improve the combustion, the exhaust gas was recirculated in a cylinder-selective manner. This has been realized by individual flaps that are arranged in individual exhaust-gas recirculation lines leading to the cylinders and that are actuated in common, as is known, e.g., from DE 19842349, as well as by a recirculation of the exhaust gases performed internally of the cylinders or near the cylinders. Such a system is known from DE 10 2005 025 904. In this case, however, additional non-return flaps and several dosing valves have to be provided in the exhaust-gas recirculation lines.

A particular disadvantage in the external recirculation of exhaust gases has been found to reside in the large volumes of exhaust-gas recirculation channels. By the provision of individual throttling members in the exhaust-gas recirculation channels, it has been accomplished to reduce the emission of pollutants because of the possibility of a precise control of the residual gas for each cylinder. However, these known systems are operated with common actuation for all individual exhaust-gas recirculation channels so that, each time, all of the exhaust-gas recirculation lines will be opened synchronously.

A cylinder-selective recirculation system of the above type is disclosed by DE 198 51 922 A1, wherein, downstream of a exhaust-gas return valve, a tube adapted to be rotated by an electric actuator means is arranged in a bore of the suction tube of the internal combustion engine. The tube, acting as a distributor element, is provided with a number of openings via which a connection can be established to an exhaust-gas recirculation channel leading to a suction channel. Thereby, the exhaust gas will be recirculated near the cylinder only at a late point of time, thus avoiding the occurrence of vibrations caused by recirculated exhaust gas in the suction tube that would disturb the charging.

Further, from DE 37 22 048 A1, there is known an exhaust-gas recirculation device comprising a housing accommodating an exhaust-gas inlet channel and a plurality of exhaust-gas outlet channels corresponding in number to the cylinders of the internal combustion engine. Between the exhaust-gas inlet channel and the exhaust-gas outlet channels, a distributor element is arranged in the housing, wherein the distributor element is driven at the rotational speed of the camshaft and has a passage formed therein by which, during rotation of the distributor element, a fluidic connection of the exhaust-gas inlet channel with a respective one of the exhaust-gas outlet channels is established. A phase shift for an upstream or downstream displacement of the exhaust gas, or for adaptation to changed opening times, is not provided.

Known from U.S. Pat. No. 6,308,666 B1 is an internal exhaust gas recirculation system wherein the exhaust gas is recirculated from the outlet valve of a first cylinder to the outlet valve of an adjacent second cylinder. For preventing such a recirculation flow, the connection tube between the two cylinders is provided with a branch while, within the tube downstream of this branch, a rotatable element is arranged for controlling an exhaust gas quantity to be discharged into the atmosphere. The element will rotate at the speed of the camshaft. By means of a phase shifter, the exhaust gas quantity to be recirculated and respectively discharged can be changed.

For further improvement of untreated emission, developments are focusing particularly on variable valve drives which, however, offer only quite complex and thus expensive options for internal control of residual gas. Less expensive state-of-the-art systems for external exhaust gas recirculation, on the other hand, suffer from the disadvantages of insufficient dynamics of the system, and are disadvantageous with respect to the dosing of the recirculated exhaust gas and the assigning of the gas to the individual cylinders.

Thus, there is posed the object of providing an exhaust-gas recirculation device operating in a cylinder-selective and cyclically precise manner, so that exhaust gas can be externally supplied to the individual cylinders respectively at an optimum point of time.

SUMMARY OF THE INVENTION

The above object is achieved by the characterizing part of the main or first embodiment of the invention, which pertains to an exhaust-gas recirculation device for an internal combustion engine, which includes (a) an exhaust-gas quantity controller; and (b) a housing having arranged therein an exhaust-gas inlet channel and a plurality exhaust-gas outlet channels corresponding in number to the cylinders of the internal combustion engine; (c) a movable distributor element arranged between the exhaust-gas inlet channel and the exhaust-gas outlet channels, wherein the distributor element (14) is driven corresponding to the rotational speed of a camshaft (11) of the internal combustion engine (1) and, via the distributor element (14), a fluidic connection of the exhaust-gas inlet channel (13) to respectively one of the exhaust-gas outlet channels (16) can be established, wherein the exhaust gas recirculation device (9) further comprises a control element (22) that is movable via an actuator (47) and by which clearing of the fluidic connection between the outlet opening (21) of the distributor element (14) and the exhaust-gas outlet channels (16) of the exhaust gas recirculation device (9) can be shifted in comparison to the phase angle of the camshaft (11). In this manner, it is possible that a precisely dosed quantity of exhaust gas is supplied to each individual cylinder at the optimum point of time and with a cyclic precision corresponding to the opening phases of the inlet valves of the internal combustion engine. Thus, a control element of this type will act as an element effecting a temporal shifting of the exhaust-gas recirculation flow in comparison with the respective opening of the inlet valves so that exhaust gas can be supplied, e.g., at an earlier point, if desired. Consequently, according to the operational condition of the engine, it is made possible to adapt the point of time for recirculating the exhaust gas to the cylinder so that an optimum point of time can be set in each case.

According to a second embodiment of the present invention, the first embodiment is modified so that the distributor element (14) is connected to the camshaft (11) via a coupling means (15) and is arranged to rotate at the rotational speed of the camshaft (11). In accordance with a third embodiment of the present invention, the first embodiment is modified so that the distributor element (14) comprises an inlet opening (19) arranged in fluidic connection to the exhaust-gas inlet channel (13), and comprises an outlet opening (21) connectible to respectively one of the exhaust-gas outlet channels (16). In accordance with a fourth embodiment of the present invention, the first embodiment is modified so that the distributor element (14) has a cylindrical outer surface (30). According to a fifth embodiment of the present invention, the fourth embodiment is further modified so that the distributor element (14) has its cylindrical outer surface (30) provided with a first groove (31) extending at least in the axial direction and serving as an outlet opening (21), and a second groove (32) being in fluidic connection with the first groove (31), wherein the second groove (32) is extending along the circumference of the outer surface (30) of the distributor element (31) and is serving as an inlet opening (19). In accordance with a sixth embodiment of the present invention, the fifth embodiment is further modified so that the distributor element (14) is arranged in the housing (12) for axial displacement therein, and the first groove (31) is arranged on the outer surface (30) of the distributor element (14) at an angle relative to the central axis so that the distributor element (14) serves as a control element (22).

In accordance with a seventh embodiment of the present invention, the fourth embodiment is further modified so that the distributor element (14) has a circular base face (40) which is formed with an inlet opening (19) in fluidic connection with an outlet opening (21) arranged on the cylindrical outer surface (30) of the distributor element (14). In accordance with an eighth embodiment of the present invention, the seventh embodiment is further modified so that the circular base plate (40) of the distributor element (14) is formed with an annular groove (41) serving as an inlet opening (19) and having an outer diameter smaller than the diameter of the cylindrical outer surface (30). In accordance with a ninth embodiment of the present invention, the seventh embodiment is further modified so that the distributor element (14) comprises a central inlet opening (19).

In accordance with a tenth embodiment of the present invention, the fourth embodiment is further modified so that the control element (22) comprises a hollow cylindrical wall (48) formed with through openings (23) corresponding in number to the cylinders (2) of the internal combustion engine (1), wherein the hollow cylindrical wall (48) is arranged between the distributor element (14) and the exhaust-gas outlet channels (16) at least by that portion of the wall which comprises the through openings (23), and the dimension of the through openings (23) in the circumferential direction is smaller than the dimension of the ends (24) of the exhaust-gas outlet channels (16) adjoining in the flow direction. In accordance with an eleventh embodiment of the present invention, the tenth embodiment is further modified so that the exhaust-gas quantity controller (8) is formed by the control element (22) which is arranged in the housing (12) for axial displacement therein, with the axial height of the through openings (23) corresponding to the height of the adjoining ends (24) of the exhaust-gas outlet channels (16).

In accordance with a twelfth embodiment of the invention, the fires embodiment is modified so that the control element (22) is formed as a rotatable disk provided with axial through openings (23) corresponding in number to the cylinders, and is arranged between a distributor element (14) rotating at the rotational speed of the camshaft and having an inlet opening and an outlet opening (19,21), and a part of the housing (12) is provided with exhaust-gas outlet channels (16) corresponding in number to the cylinders, and the ends of the exhaust-gas outlet channels (16) facing towards the control element (22) have a larger size in the circumferential direction than the through openings (23) of the control elements (22). In accordance with a thirteenth embodiment of the present invention, the first embodiment is modified so that the exhaust-gas quantity controller (8) is an exhaust-gas return valve arranged in the exhaust-gas inlet channel (13).

According to an advantageous embodiment of the invention, the distributor element is connected to the camshaft via a coupling member and rotates at the rotational speed of the camshaft. This can be safeguarded, for instance, by a form-locking coupling or corresponding toothed-wheel or belt drives. In this manner, the drive of the distributor element will be effective with exactly the same rotational speed as the camshaft so that the cyclic precision is guaranteed in a simple manner.

According to a modified embodiment, the distributor element comprises an inlet opening in fluidic connection with the exhaust-gas inlet channel, and an outlet opening connectable to one, respectively, of the exhaust-gas outlet channels. Thus, in the case of a transmission ratio 1:1 between the camshaft and the distributor element, the exhaust gas will each time be recirculated to the respective cylinder, e.g., exactly at that point of time when the inlet valve is in the opened condition.

According to a special embodiment, the distributor element has a cylindrical outer surface, thus allowing the distributor element to be rotated while at the same time maintaining a reliable sealing. According to an embodiment modifying the above embodiment, the distributor element has its cylindrical outer surface provided with a first groove extending at least in the axial direction and serving as an outlet opening, and a further groove that is in fluidic connection with the first groove while, however, extending along the circumference of the outer surface of the distributor element and serving as an inlet opening. In such an embodiment, the groove will be filled with exhaust gas in the opened condition of the exhaust gas quantity controller so that, upon rotation of the cylindrical outer surface, the exhaust gas can flow via the first groove to the exhaust-gas outlet. Such a flow will occur each time when the outlet opening and the exhaust-gas outlet channel are in mutual overlap. This overlap will take place, per cylinder, once for every rotation of the distributor element. In this manner, the distribution can be realized by use of a distributor element in a simple and inexpensive manner.

According to an embodiment modifying the above embodiment, the distributor element is arranged in the housing for axial displacement therein, and the first groove is arranged on the outer surface of the distributor element at an angle relative to the central axis so that the distributor element will also serve as a control element. When using such a groove extending at an angle relative to the central axis, the phase angle of the overlap of the exhaust-gas outlet channel with the outlet opening of the distributor element is changed relative to the camshaft angle as a result of the axial displacement of the piston, so that the function of the distributor element and the function of the control element serving for phase displacement can be integrated into one component in a simple manner.

According to an alternative embodiment, the distributor element has a circular base face, which is formed with an inlet opening that in turn is in fluidic connection with an outlet opening arranged on the outer surface of the cylinder. A distributor element of this type can also be given a smaller axial size in comparison with the above described embodiment. In this arrangement, the oncoming flow will move axially so that, depending on the available constructional space, a preferred one of the above embodiments can be chosen.

According to an embodiment modifying the above embodiment, the circular base plate of the distributor element is formed with an annular groove serving as an inlet opening and having an outer diameter smaller than the diameter of the cylindrical outer surface. Thus, also when using an axial but not central intake, the groove will be permanently filled with exhaust gas, provided that an exhaust-gas quantity controller arranged at an upstream position will allow such an exhaust gas flow.

By way of alternative to the above, the distributor element is formed with a central inlet opening. By means of such an inlet opening, larger flow cross sections can be realized in the distributor element. Also the manufacture of such an element is less expensive when compared to the above embodiment.

Preferably, the control element comprises a hollow cylindrical wall formed with through openings corresponding in number to the cylinders of the internal combustion engine, and the hollow cylindrical wall is arranged between the distributor element and the exhaust-gas outlet channels at least by that portion of the wall that comprises the through openings, and the dimension of the through openings in the circumferential direction is smaller than the dimension of the ends of the exhaust-gas outlet channels following in the flow direction. Such a control element can be realized, e.g., as a hollow cylinder having one open end, and thus can radially surround the distributor element. By turning this control element relative to the exhaust-gas outlet channels, it is again possible to shift the phase angle forward or backward relative to the phase angle of the camshaft, i.e., to displace the phase angle. Also a turning movement to a position next to the exhaust-gas outlet channels can be performed; in this case, the exhaust gas flow would be stopped completely. As to the dimension in the circumferential direction, the through openings can have substantially the same size as the outlet opening of the distributor element so that, at a specific point of time per rotation, there would exist an exact overlap of both openings. At this point of time, the maximum possible exhaust gas flow would be recirculated to the respective cylinder.

According to an embodiment modifying the above embodiment, the exhaust-gas quantity controller is formed by the control element that is arranged in the housing for axial displacement therein, while the axial height of the through opening corresponds to the height of the following ends of the exhaust-gas outlet channels. This means that, by an axial displacement of the control element, the respective window to be opened is made smaller relative to the exhaust-gas outlet channel. Thereby, one can realize an exhaust-gas quantity control with a simultaneous possibility of phase shifting. As a result, the recirculated exhaust-gas quantity, as well as the point of time, can be precisely adapted to the requirements of the internal combustion engine.

According to an embodiment provided as an alternative to the two aforementioned embodiments, the control element is formed as a rotatable disk provided with axial through openings corresponding in number to the cylinders, and is arranged between a distributor element rotating at the rotational speed of the camshaft and having an inlet opening and an outlet opening, and a part of the housing is provided with exhaust-gas outlet channels corresponding in number to the cylinders, wherein the ends of the exhaust-gas outlet channels facing towards the control element have a larger size in the circumferential direction than the through openings of the control elements. The result is a distributor and control element having a very flat configuration and which, apart from this, will guarantee the same cyclically precise and cylinder-selective exhaust-gas recirculation as in the other embodiments. Here, it is of advantage that a complete axial through-flow without changes of direction of the flow paths is realized.

Preferably, the exhaust-gas quantity controller is an exhaust-gas return valve, which is arranged in the exhaust-gas inlet channel and can be realized, e.g., as a cone valve. With a valve of this kind, a precise dosing of the exhaust-gas quantity can be reliably accomplished.

These embodiments will distinctly improve the system dynamics as known to date and improve the EGR amount for each cylinder. This allows for a dosing precisely adapted to the cycle and thus for optimum combustion during exhaust-gas recirculation.

Embodiments of the invention are illustrated in the drawings and will be described below as follows.

DETAILED DESCRIPTION OF PREFERRED EMBODIMENTS OF THE INVENTION

Figure 1:
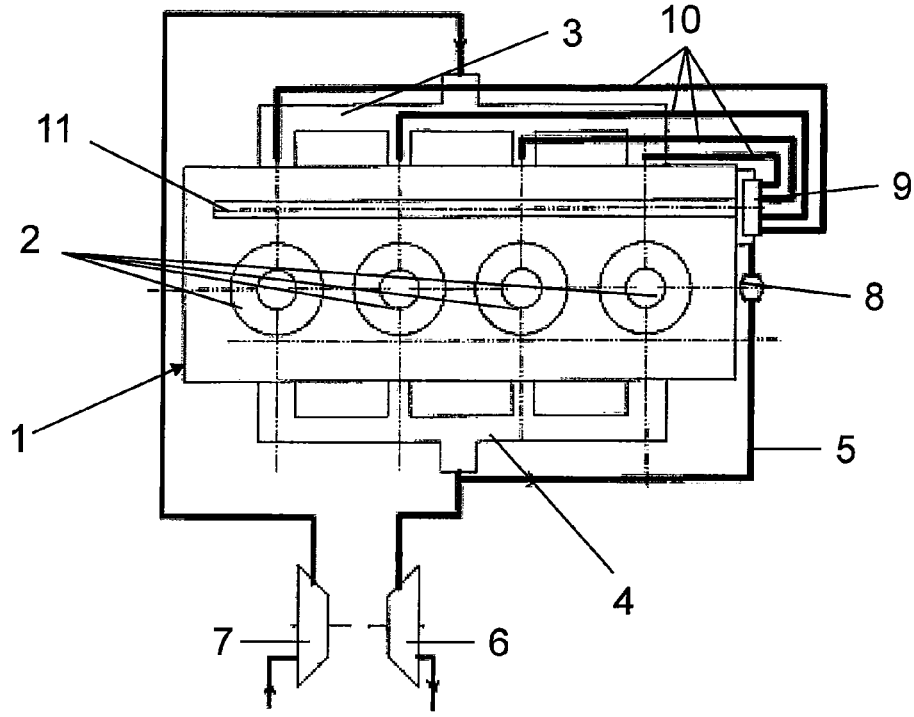
FIG. 1 is a schematic view of an exhaust-gas recirculation device of the present invention as arranged in an internal combustion engine.

FIG. 1 illustrates an internal combustion engine 1 comprising four cylinders 2 supplied with air via a suction tube 3. Downstream of an exhaust manifold 4, exhaust gas is recirculated to the internal combustion engine 1 via an external exhaust-gas recirculation line 5. The rest of the exhaust gas flow will be discharged into the atmosphere via a turbine 6. Suction tube 3 receives the air via a compressor 7 coupled to turbine 6. In the exhaust-gas recirculation line 5, an exhaust-gas quantity controller 8 is provided which is arranged upstream of an exhaust-gas recirculation device 9 having the controlled gas from the exhaust-gas quantity controller 8 flowing into it. From the exhaust-gas recirculation device 9, four individual gas recirculation lines 10 lead to the individual suction channels of suction tube 3 or directly to the individual inlet channels of the cylinders 2 of the internal combustion engine. According to the invention, exhaust-gas recirculation device 9 is coupled to a camshaft 11 of internal combustion engine 1. The manner in which this coupling can be brought about so as to effect a recirculation flow of the exhaust gas in a cyclically precise manner, is illustrated in the Figures to be discussed below.

Figure 2:
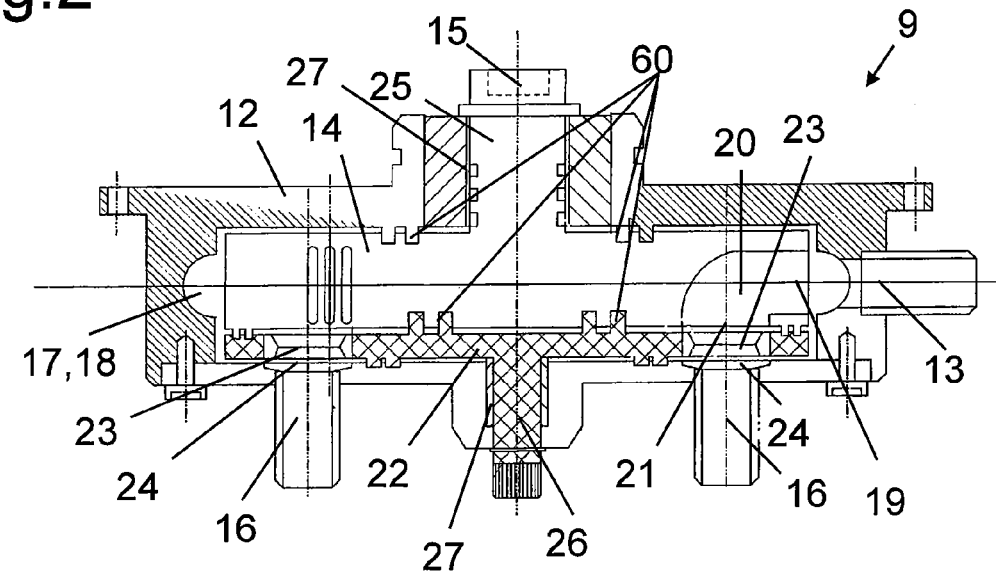
FIG. 2 is a sectional lateral view of a first embodiment of an exhaust-gas recirculation device of the present invention.

FIG. 2 shows a first embodiment of the invention wherein the exhaust-gas recirculation device 9 comprises a housing 12 with an exhaust-gas inlet channel 13 formed therein which connects to a distributor element 14 that, via a coupling means 15 formed on a pivot 25 of distributor element 14, is connectable to camshaft 11 and thus, during operation of the internal combustion engine, will rotate in housing 12 at the rotational speed of camshaft 11. Apart from the exhaust-gas inlet channel 13 arranged in housing 12, four exhaust-gas outlet channels 16 are formed in housing 12 corresponding in number to the cylinders 2 of internal combustion engine 1; in FIG. 2, two of the channels 16 are shown. Exhaust-gas inlet channel 13 is radially arranged in the cylindrical housing 12 in correspondence to the cylindrical shape of the rotating distributor element 14, while the four exhaust-gas outlet channels 16 are uniformly distributed at equal distances, i.e., at a distance of respectively 90° relative to each other, and extend in axial direction. Internally of housing 12, a surrounding groove 17 is provided in the housing around distributor element 14, wherein the groove forms a channel 18 for uniform distribution of inflowing gas from exhaust-gas inlet channel 13 along the circumference of distributor element 14. The channel 18 is in permanent fluidic connection to an inlet opening 19 of distributor element 14 so that exhaust gas can flow into distributor element 14 respectively via inlet opening 19.

In the present embodiment, distributor element 14 includes a flow channel 20 entering an axial outlet opening 21 and safeguarding a permanent fluidic connection between outlet opening 21 and exhaust-gas inlet channel 13. The outlet opening 21 is arranged at the same radial distance from the rotational axis of distributor element 14 as the exhaust-gas outlet channels 16 of housing 12 so that, at each rotation of distributor element 14, there will occur respectively one overlap of outlet opening 21 with each of the exhaust-gas outlet channels 16. Of course, it could also be provided to form the distributor element 14 as a flat disk and thus to cause exhaust gas to be introduced into the whole region above distributor element 14 so that, in this case, an axial through opening in the disk would fulfill the functions of channel 20 as well as of inlet opening 19 and outlet opening 21.

Between the distributor element 14 and the housing 12 with the exhaust-gas outlet channels 16, there is further provided a control element 22 comprising four through openings 23 which again are arranged at the same radial distance from the rotational axis of distributor element 14 as the outlet opening 21 and the exhaust-gas outlet channels 16, respectively. Also this control element 22 is formed as a circular disk and comprises a central pivot 26 allowing the circular control element 22 to be rotated with housing 12 by means of an actuator (not shown).

In the circumferential direction of control element 22, the through openings 23 of control element 22 are formed with a shorter length than corresponding ends 24 of the exhaust-gas outlet channels 16. In this manner, it is rendered possible, by slightly rotating the control element 22, to shift the point of time of the recirculation flow of exhaust gas to the respective cylinder 2 towards a later or earlier point in comparison to the rotational angle of camshaft 11.

If, for instance, the through opening 23 of control element 22 is rotated in a sense opposite to the rotational direction of the camshaft, this will result in an earlier overlap of outlet opening 21 of distributor element 14 with the corresponding through opening 23 of control element 22, thus causing the supply of exhaust gas to the cylinders to occur at an earlier time. Of course, also a rotation into the opposite direction can be performed for shifting the recirculation of exhaust gas during a cycle.

For reliable fulfillment of the function, it is required that the distributor element 14 and the control element 22 be sealed relative to each other and towards housing 12, which can be effected, e.g., by grooves acting as a labyrinth seal 60 and by corresponding webs. Control element 22 and distributor element 14 are supported by axial pivots 25,26 arranged in suitable bearing units 27 in housing 12. Furthermore, additional sealing elements can be used for sealing against the outside.

In the description of the following Figures, functionally identical components are provided with identical reference numerals throughout.

Figure 3:
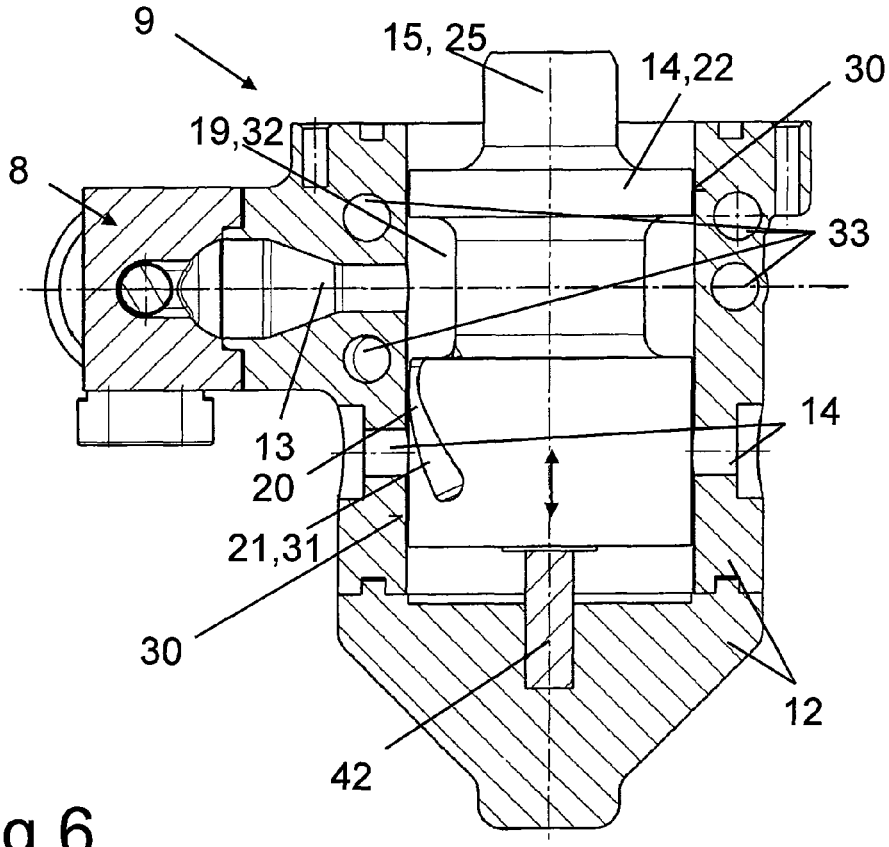
FIG. 3 is a sectional lateral view of a second embodiment of an exhaust-gas recirculation device of the present invention.

The alternative embodiment of the inventive exhaust-gas recirculation device 9, as shown in FIG. 3, comprises a multipart housing 12 which again accommodates the distributor element 14 having a cylindrical outer surface 30. On its axial ends, distributor element 14 is provided with a respective pivot 25, 42, one of them serving as a coupling 15 to camshaft 11 and the other being supported in housing 12.

The cylindrical outer surface 30 is formed with a first groove 31 extending on the cylindrical outer surface 30 both in the axial and in the circumferential direction simultaneously. This means that the first groove 31 is arranged at an angle relative to the rotational axis of distributor element 14. The first groove 31 serves both as an outlet opening 21 by which exhaust gas flowing into housing 12 is conveyed to an exhaust-gas outlet channel formed on the housing and extending radially to distributor element 14, and as a channel 20 for fluidic connection to an inlet opening 19 of distributor element 14. The inlet opening 19 is formed by a second groove 32 that extends in the circumferential direction and is arranged in fluidic connection to a radial exhaust-gas inlet channel 13 formed in housing 12. Arranged in the exhaust-gas inlet channel is an exhaust-gas quantity controller 8 designed as a exhaust-gas return valve, which is held on housing 12 by a flange connection.

Also in this embodiment, a total of four exhaust-gas outlet channels 16 are formed in housing 12, wherein the exhaust-gas outlet channels 16 are again distributed at equal intervals around the circumference and extending radially; for this embodiment alike, only two of them are illustrated. When the distributor element 14 is now rotated at the rotational speed of the camshaft, this will again have the effect that, during each rotation, there is once per exhaust-gas outlet channel 16 generated a fluidic connection from the channel to the exhaust-gas inlet channel 13, thus causing exhaust gas to be recirculated to the respective connected cylinder 2. Accordingly, the exhaust-gas recirculation device will also here be suited for use in a four-cylinder internal combustion engine. Furthermore, housing 12 includes a cooling channel 33 configured in a plurality of windings around the first groove 31 so that, in this exhaust-gas recirculation device 9, the exhaust gas can also be cooled.

The distributor element 14 is arranged in housing 12 not only for rotation therein, but can also be axially displaced in housing 12 by means of an actuator (not shown). In this manner, it is accomplished that the oblique first groove 31 is displaced towards the exhaust-gas outlet channels 16, whereby the respective connection between the exhaust-gas inlet channel 13 and the exhaust-gas outlet channels 16 is displaced relative to the existing rotational angle of camshaft 11 and, thus, relative to the point of time that the inlet valves are opened. Therefore, this distributor element 14 also serves as a control element 22, so that the dosing can be performed in a cyclically precise manner and it is made possible, for instance, to move the recirculated gas farther towards the inlet valve. The time of supply will thus depend on the axial position of distributor element 14.

It should be evident that, in such an embodiment, the coupling means 15 to camshaft 11 has to be adapted to the above arrangement and that, for axial adjustment, it is required, e.g., to connect the pivot 25 to the corresponding actuator. Also, in this embodiment, a corresponding support and sealing of the distributor element has to be provided.

Figure 4:
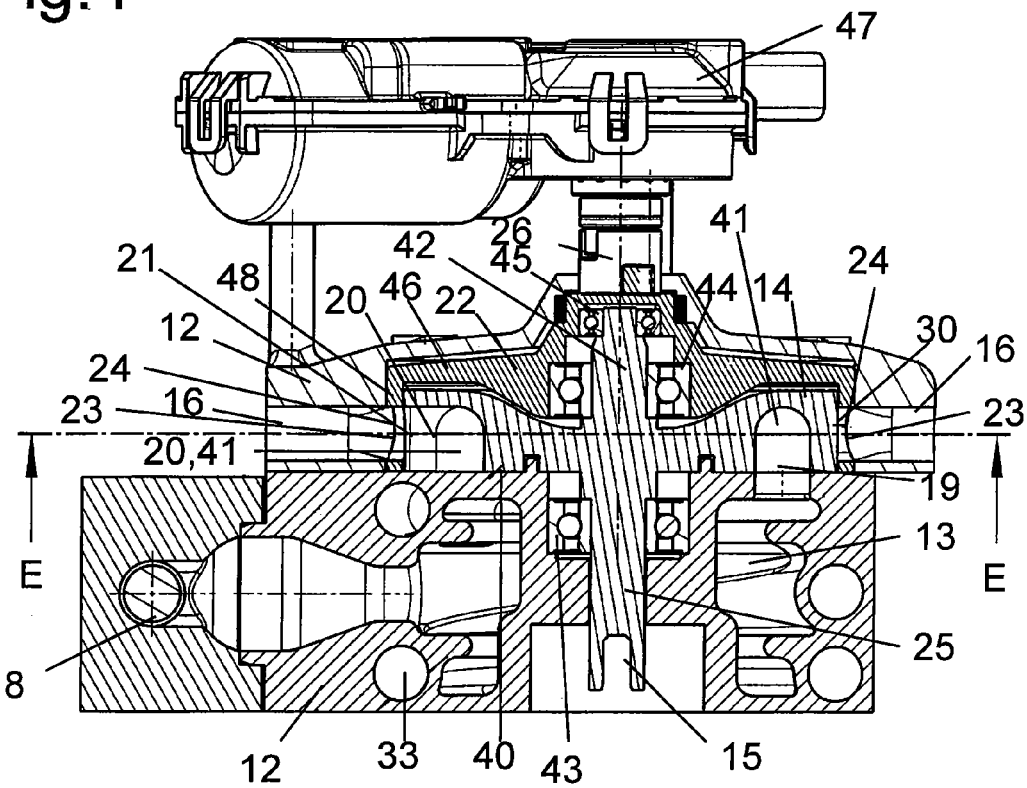
FIG. 4 is a sectional lateral view of a third embodiment of an exhaust-gas recirculation device of the present invention.

In FIG. 4, there is shown a further alternative exhaust-gas recirculation device 9, which again comprises a exhaust-gas quantity controller 8 arranged in an exhaust-gas inlet channel 13 and allowing gas to flow into housing 12. The housing 12 is again of a multi-part type, and the housing portion adjoining to the exhaust-gas quantity controller 8 is again provided with a cooling channel 33.

Exhaust-gas inlet channel 13 extends to distributor element 14, which in the present embodiment comprises a circular base face 40 formed with an annular groove 41 as an inlet opening 19 of the distributor element to the exhaust-gas inlet channel 13. The annular groove 41 has a smaller diameter than the cylindrical outer surface 30 of distributor element 14. The groove is in fluidic connection to radial outlet opening 21 adapted to establish a fluidic connection to respectively one of the four exhaust-gas outlet channels 16, which again are formed in housing 12.

Also in this embodiment, distributor element 14 is provided with two pivots 25, 42, wherein the coupling 15 to camshaft 11 is integrally formed to the end of pivot 25. The pivot 25 further serves as a bearing site for distributor element 14 within housing 12, while this bearing unit 43 is formed as a ball bearing. A Iso, the other pivot 42, extending in the opposite axial direction, is supported in two bearings 44, 45, their outer rings respectively abutting a substantially bell-shaped control element 22. The control element thus comprises a hollow cylindrical wall 48 radially surrounding the distributor element 14 while the top face of the bell-shaped control element 22 covers the top face 46 of distributor element 14 opposite to the base face 40. Control element 22 is arranged in housing 12 for rotation by means of an actuator 47.

Figure 5:
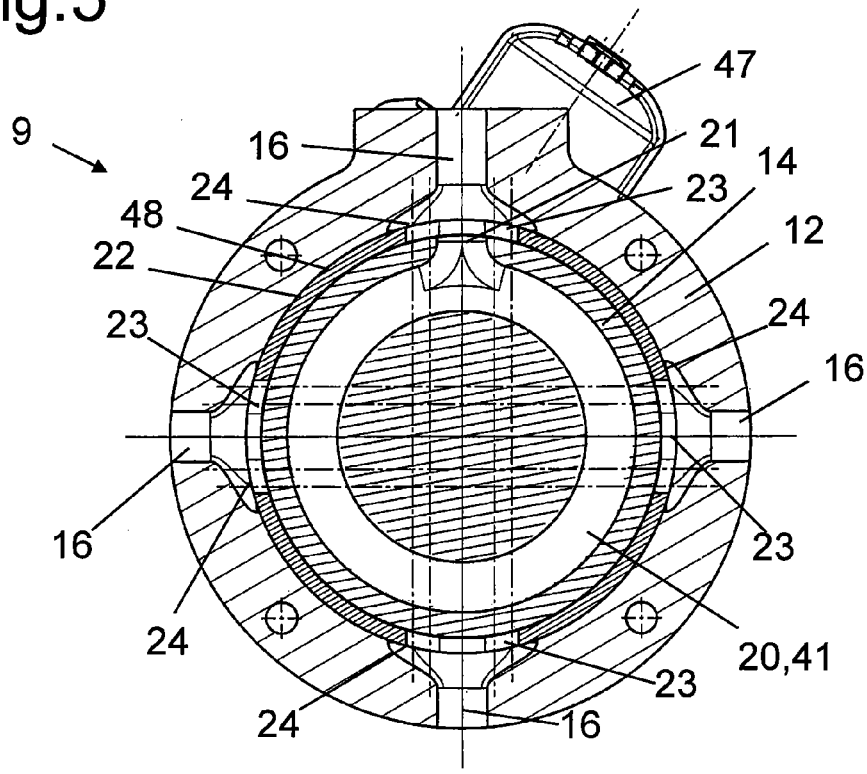
FIG. 5 is a sectional plan view of the inventive exhaust-gas recirculation device of FIG. 4.

In FIG. 5, which is a sectional view taken along the line E-E in FIG. 4, it can be seen that also this control element 22 is provided with through openings 23 whose dimension in the circumferential direction is smaller than that of the end 24 of the exhaust-gas outlet channels 16, which is facing towards the through openings 23. The outlet opening 21 of distributor element 14 is of a still smaller size relative to the circumferential dimension. In this Figure, it is clearly visible that, upon rotation of distributor element 14 at the rotational speed of the camshaft, each of the four exhaust-gas outlet channels 16 will be swept over by the outlet opening 21 once per rotation, so that, at this time, gas can flow into the respective exhaust-gas outlet channel 16, provided that the exhaust-gas quantity controller 8 will clear a corresponding cross-sectional area. If one now assumes that the distributor element 14 is rotating in the clockwise direction and that, at the same time, the control element 22 is moved in the counterclockwise direction by means of actuator 47, e.g., in such a manner that respectively the front edge of the through opening 23 and the end 24 of the exhaust-gas outlet channels 16 will lie above each other, it becomes evident that the fluidic connection, when seen in comparison with the rotation of camshaft 11 and to the clearing of the respective inlet valve, has been shifted forward in time. In an equivalent manner, when the control element 22 is moved in the clockwise direction, the point of time of the recirculation of the exhaust can be shifted rearward in comparison with the clearing of the inlet valve of cylinder 2. As further obvious, it is possible to rotate the control element 22 so far that the through openings 23 will be arranged outside the range of the ends 24 of the exhaust-gas outlet channels 16 so that the recirculated exhaust-gas flow can be completely interrupted.

Returning now to FIG. 4, it becomes evident that, at the same height of the through openings 23 and the ends 24 of the exhaust-gas outlet channels, an axial displacement of distributor element 14 could be used also for controlling the exhaust-gas quantity, thus obviating the need for the exhaust-gas quantity controller 8 at the upstream position. For this purpose, of course, an axial actuator would have to be provided at the control element 22. Also, the free height of housing 12, which in the present embodiment axially delimits the control element 22, would, of course, have to be selected differently. It goes without saying that also this embodiment would require corresponding sealing means.

Figure 6:
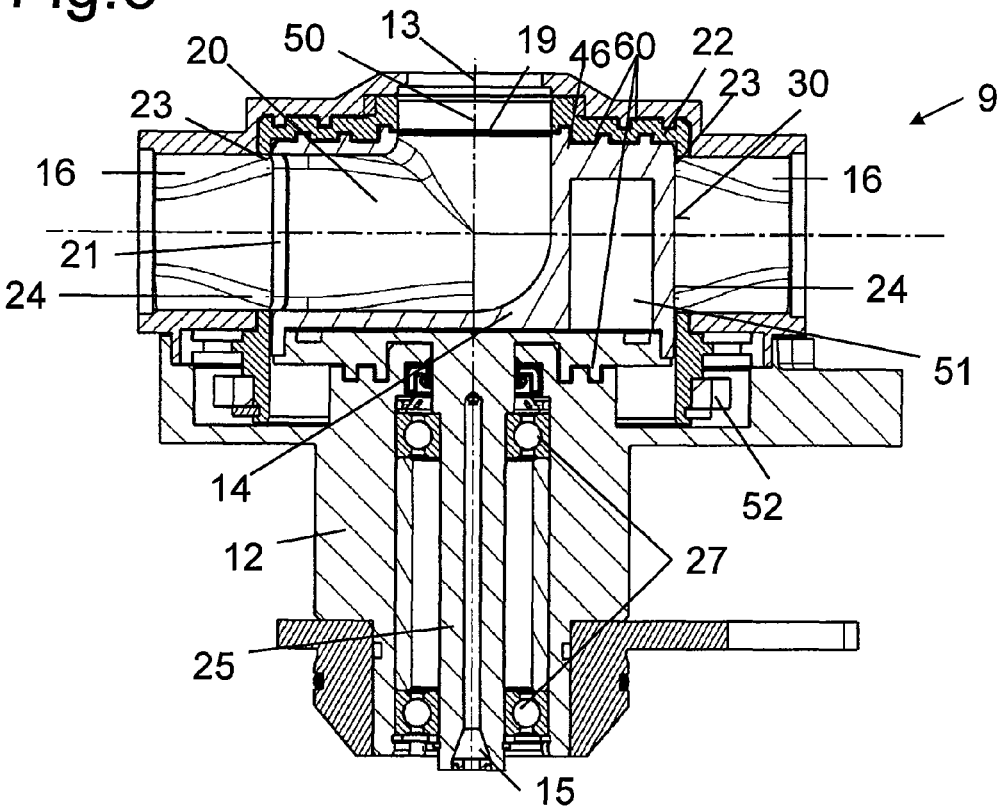
FIG. 6 is a sectional lateral view of a further alternative embodiment of an exhaust-gas recirculation device of the present invention.

The embodiment according to FIG. 6 is largely similar to the one according to FIG. 5 while, however, in the embodiment according to FIG. 6 the exhaust-gas inlet channel 13 is arranged centrally in the region of the rotational axis of distributor element 14. In accordance thereto, also control element 22 comprises a corresponding axial through opening 50, with the central inlet opening 19 of distributor element 14 entering the opening 50. In the distributor element 14, there is again provided the channel 20 for fluidic connection to the radial outlet opening 21 of distributor element 14, which channel is in the required manner connectible to the respective exhaust-gas outlet channel 16 via the radial through opening 23 of control element 22 by rotating the distributor element 14.

As in the previous embodiment, the distributor element 14, of course, comprises one outlet opening 21 while the control element 22 as well as the housing 12 again comprise four exhaust-gas outlet channels 16 and four through openings 23, respectively, of which two are illustrated.

For reducing the constructional weight, the distributor element 14 is provided with cavities 51. Of course, in the present embodiment, due to the central infeed of the exhaust gas, the actuator (not shown) has to be arranged in a different manner for driving the control element 22. For this purpose, the control element 22 is provided with a toothed wheel 52 meshing with a toothed wheel (not shown), which can be arranged, e.g., on the shaft of an actuator 47.

In the above arrangement, the distributor element 14 is supported unilaterally by two ball bearings forming the bearing unit 27, wherein the pivot 25 leading to the camshaft 11 must have a distinctly larger length. As further evident from the drawings, both the outer housing 12 and the distributor element 14 and the control element 22 are provided with mutually corresponding grooves and webs which, as had been the case in the first embodiment, serve as labyrinth sealings 60. Furthermore, an annular sealing 53 is arranged in the region of exhaust-gas inlet channel 11, serving the same purpose.

As the description has shown, the explained embodiments provide an exhaust-gas recirculation device that operates in a cylinder-selective and cyclically precise manner, allowing for a phase shift relative to the rotational angle of the camshaft and, thus, relative to the opening time of the inlet valve of the respective cylinders. In this manner, pollutant emissions of internal combustion engines can be further reduced. There is thus obtained a process-synchronous exhaust-gas recirculation control with merely very short idle times.

In other words, an exhaust-gas recirculation device, in accordance with the present invention, generally includes a distributor element (14) that is driven corresponding to the rotational speed of the camshaft (11) of an internal combustion engine (1), wherein, via the distributor element (14), a fluidic connection can be established from an exhaust-gas inlet channel (13) to respectively one exhaust-gas outlet channel (16) of a plurality of exhaust-gas outlet channels (16) corresponding in number to the cylinders. Advantageously, apart from the distributor element (14), use can be made of a control element (22) that is movable via an actuator (47) and by which clearing of the fluidic connection between the outlet opening (21) of the distributor element (14) and the exhaust-gas outlet channels (16) of the exhaust gas recirculation device (9) can be shifted in comparison to the phase angle of the camshaft (11). Exhaust-gas recirculation devices of the above type serve for cylinder-selective recirculation of exhaust gas to the individual cylinders of an internal combustion engine and will operate in a cyclically precise manner. Advantageously, it is further possible to effect a phase shift of the cycle relative to the camshaft, resulting in a considerable reduction of the emissions of an internal combustion engine. An exhaust-gas recirculation device of the above design can also be of relevance for combustion control in novel combustion methods.

Of course, for the intended purpose, there can also be provided various exhaust-gas recirculation devices of a constructive design differing from the above described embodiments wherein, according to the invention, it should particularly be provided that the distributor element is driven at a rotational speed corresponding to that of the camshaft, so as to establish a connection of the respective exhaust-gas recirculation channel in correspondence with the cycle of the internal combustion engine. It can also be provided to give the control openings of the distributor element a contoured shape to the effect that, if required, the development of the volume flow can be changed by means of the opening of an inlet valve.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims, and equivalents thereof.

The invention claimed is:

1. An exhaust-gas recirculation device arranged in an internal combustion engine, the exhaust-gas recirculation device comprising:

(a) an exhaust-gas quantity controller;

(b) a housing having arranged therein an exhaust-gas inlet channel_and a plurality exhaust-gas outlet channels corresponding in number to cylinders of the internal combustion engine;

(c) movable distributor element arranged between the exhaust-gas inlet channel and the exhaust-gas outlet channels, wherein the distributor element is driven corresponding to a rotational speed of a camshaft of the internal combustion engine, and, via the distributor element, a fluidic connection of the exhaust-gas inlet channel to a respective one of the exhaust-gas outlet channels is established; and (d) a control element that is movable via an actuator and the control element operates to shift clearing of the fluidic connection between the outlet opening of the distributor element and the exhaust-gas outlet channels of the exhaust gas recirculation device in comparison to a phase angle of the camshaft of the internal combustion engine.

2. The exhaust-gas recirculation device arranged in an internal combustion engine according to claim 1, wherein the distributor element is connected to the camshaft of the internal combustion engine via a coupling means and is arranged to rotate at the rotational speed of the camshaft.

3. The exhaust-gas recirculation device arranged in an internal combustion engine according to claim 1, wherein the distributor element comprises i. an inlet opening arranged in fluidic connection to the exhaust-gas inlet channel;

ii. an outlet opening connectable to the respective one of the exhaust-gas outlet channels.

4. The exhaust-gas recirculation device arranged in an internal combustion engine according to claim 1, wherein the distributor element has a cylindrical outer surface.

5. The exhaust-gas recirculation device arranged in an internal combustion engine according to claim 4, wherein the cylindrical outer surface of the distributor element is provided with a first groove extending at least in an axial direction and the first groove serves as an outlet opening, and a second groove that is in fluidic connection with the first groove, wherein the second groove extends along a circumference of the cylindrical outer surface of the distributor element and serves as an inlet opening.

6. The exhaust-gas recirculation device arranged in an internal combustion engine according to claim 5, wherein the distributor element is arranged in the housing for axial displacement therein, and the first groove is arranged on the cylindrical outer surface of the distributor element at an angle relative to a central axis so that the distributor element serves as the control element.

7. The exhaust-gas recirculation device arranged in an internal combustion engine according to claim 4, wherein the distributor element has a circular base face that is formed with an inlet opening in fluidic connection with an outlet opening arranged on the cylindrical outer surface of the distributor element.

8. The exhaust-gas recirculation device arranged in an internal combustion engine according to claim 7, wherein the circular base plate of the distributor element is formed with an annular groove serving as the inlet opening and having an outer diameter smaller than a diameter of the cylindrical outer surface.

9. The exhaust-gas recirculation device arranged in an internal combustion engine according to claim 7, wherein the inlet opening of the distributor element comprises a central inlet opening.

10. The exhaust-gas recirculation device arranged in an internal combustion engine according to claim 4, wherein the control element comprises a hollow cylindrical wall formed with through openings corresponding in number to the cylinders of the internal combustion engine, wherein the hollow cylindrical wall is arranged so that at least a portion of the hollow cylindrical wall is between the distributor element and the exhaust-gas outlet channels, wherein the portion of the hollow cylindrical wall comprises the through openings, and a dimension of the through openings in a circumferential direction is smaller than a dimension of ends of the exhaust-gas outlet channels adjoining in a flow direction.

11. The exhaust-gas recirculation device arranged in an internal combustion engine according to claim 10, wherein the exhaust-gas quantity controller is formed by the control element arranged in the housing for axial displacement therein, wherein an axial height of the through openings corresponds to a height of the adjoining ends of the exhaust-gas outlet channels.

12. The exhaust-gas recirculation device arranged in an internal combustion engine according to claim 1, wherein the control element is formed as a rotatable disk provided with axial through openings corresponding in number to the cylinders of the internal combustion engine, and the control element is arranged between the distributor element rotating at the rotational speed of the camshaft and having an inlet opening and an outlet opening, and a part of the housing is provided with exhaust-gas outlet channels corresponding in number to the cylinders of the internal combustion engine, and ends of the exhaust-gas outlet channels facing towards the control element have larger size in a circumferential direction than through openings of the control elements.

13. The exhaust-gas recirculation device arranged in an internal combustion engine according to claim 1, wherein the exhaust-gas quantity controller is an exhaust-gas return valve arranged in the exhaust-gas inlet channel.

* * * * *